US007497586B2

(12) United States Patent
Eisenberg et al.

(10) Patent No.: US 7,497,586 B2
(45) Date of Patent: Mar. 3, 2009

(54) INCAPACITATING HIGH INTENSITY INCOHERENT LIGHT BEAM

(75) Inventors: Todd Eisenberg, Ramona, CA (US); Herbert Parker, Carlsbad, CA (US)

(73) Assignee: Genesis Illumination, Inc., Carlsbad, CA (US)

( * ) Notice: Subject to any disclaimer, the term of this patent is extended or adjusted under 35 U.S.C. 154(b) by 14 days.

(21) Appl. No.: 11/824,120

(22) Filed: Jun. 29, 2007

(65) Prior Publication Data

US 2008/0002395 A1 Jan. 3, 2008

Related U.S. Application Data

(60) Provisional application No. 60/817,744, filed on Jun. 30, 2006.

(51) Int. Cl.
*F21V 33/00* (2006.01)

(52) U.S. Cl. ..... 362/109; 362/259; 362/264; 362/114; 42/1.28

(58) Field of Classification Search ..... 362/109, 362/202, 187, 174, 261, 264, 294; 42/1.08; 361/232
See application file for complete search history.

(56) References Cited

U.S. PATENT DOCUMENTS 3,894,289 A * 7/1975 Evans et al. ..... 372/70
4,048,631 A 9/1977 Flores
4,523,809 A 6/1985 Taboada et al.
4,586,715 A 5/1986 Scolari et al.
4,626,748 A 12/1986 Nakamura
4,963,798 A 10/1990 McDermott
5,036,444 A 7/1991 Hiles
5,060,237 A 10/1991 Peterson
5,072,342 A 12/1991 Minovitch
5,072,347 A 12/1991 Brunson
5,142,458 A 8/1992 Brunson
5,144,207 A 9/1992 Brunson
5,221,809 A 6/1993 Cuadros
5,228,770 A 7/1993 Brunson
5,243,894 A 9/1993 Minovitch
5,309,336 A 5/1994 Hartt et al.

(Continued)

OTHER PUBLICATIONS

Ashcroft, et al., "Dept. of Defense Nonlethal Weapons and Equipment Review," U.S. Dept. of Justice, 2004, pp. 1-65.

(Continued)

*Primary Examiner*—Ali Alavi
(74) *Attorney, Agent, or Firm*—The Nath Law Group

(57) ABSTRACT

A long range, high intensity spotlight for human incapacitation and control that uses an incoherent collimated constant light source of sufficient intensity and focus to cause temporary incapacitation of a person for a period of time when illuminated by the beam without causing permanent physical harm.

The high intensity spotlight comprises a head portion at one end having a window opening and a handle portion connected to the head portion and containing electronic circuitry and thermal air management for controlling operating temperature of the lamp. A paraboloid reflector is mounted in the head portion to face the window opening, and a high intensity electric arc Xenon lamp is adjustably mounted within the reflector so that the electrode gap is located as close as possible to the focus of the reflector. An adjustable mounting base allows the position of the reflector to be adjusted until the optimum focus is reached. A properly positioned cathode wire feed optimizes the lamp performance.

27 Claims, 7 Drawing Sheets

U.S. PATENT DOCUMENTS 5,351,259 A 9/1994 Ishimori et al.
5,375,043 A 12/1994 Tokunaga
5,417,573 A 5/1995 Cassiere, II et al.
5,527,308 A 6/1996 Anderson et al.
5,584,137 A 12/1996 Teetzel
5,612,503 A 3/1997 Sepp
5,675,103 A 10/1997 Herr
5,685,636 A 11/1997 German
5,713,654 A 2/1998 Scifres
5,734,504 A 3/1998 Billman
5,758,448 A * 6/1998 Thummel ..... 42/114
5,761,235 A 6/1998 Houde-Walter
5,800,481 A 9/1998 Loos
5,808,226 A 9/1998 Allen et al.
5,814,041 A 9/1998 Anderson et al.
5,831,199 A * 11/1998 McNulty et al. ..... 89/1.11
5,836,081 A 11/1998 Orosz, Jr.
5,859,915 A 1/1999 Norris
5,864,517 A 1/1999 Hinkey et al.
5,936,183 A * 8/1999 McNulty, Sr. ..... 89/1.11
5,983,548 A 11/1999 Ludaescher
6,007,218 A 12/1999 German et al.
6,007,219 A 12/1999 O'Meara
6,102,552 A 8/2000 Tullis
6,142,650 A 11/2000 Brown et al.
6,150,943 A 11/2000 Lehman et al.
6,190,022 B1 2/2001 Tocci et al.
6,229,940 B1 5/2001 Rice et al.
6,283,609 B1 9/2001 Parsons et al.
6,376,993 B1 4/2002 Romanczuk et al.
6,386,113 B1 5/2002 Pinney
6,404,613 B1 6/2002 Dowling et al.
6,431,732 B1 8/2002 Brown et al.
6,616,301 B2 9/2003 Brown et al.
6,650,070 B1 11/2003 Hudson et al.
6,702,452 B2 * 3/2004 Jigamian et al. ..... 362/205
6,722,771 B1 4/2004 Stephens
6,774,893 B2 8/2004 Debiez et al.
6,799,868 B2 10/2004 Brown et al.
6,876,302 B1 4/2005 Steeves
6,921,176 B2 * 7/2005 Tomita et al. ..... 353/94
6,962,532 B2 11/2005 Hasebe et al.
7,015,702 B2 3/2006 Rupp
7,040,780 B2 5/2006 Diehl
2003/0123254 A1 7/2003 Brass et al.
2004/0130896 A1 7/2004 Brown et al.
2004/0165380 A1 8/2004 Chew
2006/0234191 A1 * 10/2006 Ludman ..... 434/11

OTHER PUBLICATIONS

Davison, et al., "Bradford Non-Lethal weapons Research Project," Research Report No. 8, Univ. of Bradford, 2006, pp. 1-76.

* cited by examiner

INCAPACITATING HIGH INTENSITY INCOHERENT LIGHT BEAM

CROSS-REFERENCE TO RELATED APPLICATIONS

This is a regular application of provisional patent application Ser. No. 60/817,744 filed 30 Jun. 2006.

STATEMENT REGARDING FEDERALLY SPONSORED RESEARCH OR DEVELOPMENT

None

INCORPORATION-BY-REFERENCE OF MATERIAL SUBMITTED ON COMPACT DISC

None

BACKGROUND OF THE INVENTION (1) Field of the Invention

The present invention relates generally to Xenon spotlights, and is particularly concerned with hand held or portable flashlights for use as terrestrial spotlights, using air cooling for general high power long distance visibility in dark conditions.

(2) Description of Related Art

In recent years, the employment of non-lethal weapons has proven increasingly effective in dealing with adversaries in a variety of law enforcement, corrections, military, and physical security scenarios. In these areas, the goal of protection personnel in most confrontations is to employ the lowest level of force necessary to control the situation. Avoidance of collateral damage is increasingly critical for humanitarian and public policy reasons. The possible levels of response force fall ranging from verbal warnings, escalating to use of lethal weapons such as firearms. The possibility of permanent injury or unintentional death increases as response level increases. Also, as the level of force applied increases, adversaries will often escalate their response thereby increasing the risk of injury to the security personnel. Any means to minimize the level of interaction between the protector and the aggressor is therefore of great value to security personnel and their adversaries alike. Consequently security protection personnel need a response that assures their personal safety and eliminates the threat of collateral damage to the maximum extent possible.

Ultra-bright light laser sources utilizing coherent light are claimed to offer a means to control escalation of confrontations between security personnel and adversaries. These light sources provide four levels of physical interaction with adversaries at the "soft" end of the force continuum: psychological impact such as distraction and fear; temporarily impaired vision (blindness); physiological response to the light such as disorientation and nausea; and reduced ability to perform hostile acts such as throwing objects, attacking, or aiming firearms. In addition, the adversaries' response to the illumination can provide security personnel with threat assessment in terms of intent and resolve. Examples of such devices are described in U.S. Pat. Nos. 5,685,636, 6,007,218 and 7,040,780.

Within the various application areas, there are many scenarios where a non-lethal response with ultra-bright lights can be beneficial. These include perimeter protection for government and industrial facilities, apprehension of armed and unarmed but violent subjects, protection from suspected snipers, protection from assailants, and crowd/mob control.

Prison guards need non-lethal options in a variety of situations including cell extractions, breaking up fights, and controlling disturbances. Another important class of scenarios is that which limit the use of potentially lethal weapons because innocent people are present. These include hostage situations, hijackings, protection of political figures in crowds, airport security, and crowd control.

Collateral damage when using firearms or explosives on the battlefield is an increasing problem. In time-critical scenarios, such as raids on hostile facilities or criminal hideouts, where even a few seconds of distraction and visual impairment can be vital to the success of the mission, visual countermeasures can enhance the capabilities of law enforcement personnel.

Present devices utilizing coherent bright light sources are capable of a range of effects on human vision which depend primarily on the wavelength, beam intensity at the eye (measured in watts/square centimeter), and whether the light source is pulsed or continuous-wave coherent light. There are three types of non-damaging effects on vision using these sources; glare, flashblinding and physiological disorientation. All of these technologies have application disadvantages.

The glare effect is a reduced visibility condition due to a bright source of light in a person's field of view. It is a temporary effect that disappears as soon as the light source is extinguished, turned off, or directed away from the subject. The light source used must emit light in the visible portion of the spectrum and must be continuous or flashing to maintain the reduced-visibility glare effect. The degree of visual impairment due to glare depends on the brightness of the light source relative to ambient lighting conditions. The disadvantage is that the aggressor is still capable of inflicting harm and is not incapacitated.

The flashblinding effect is a reduced visibility condition that continues after a bright source of light is switched off. It appears as a spot or afterimage in one's vision that interferes with the ability to see in any direction. The nature of this impairment makes it difficult for a person to discern objects, especially small, low-contrast objects or objects at a distance. The duration of the visual impairment can range from a few seconds to several minutes. The visual impairment depends upon the brightness of the initial light exposure and the ambient lighting conditions and the person's visual objectives. The major difference between the flashblind effect and the glare effect is that visual impairment caused by flashblind remains for a short time after the light source is extinguished, whereas visual impairment due to the glare effect does not. The disadvantage it that the use of flash grenades can blind the user as well as bystanders and dispensing methods may present fire or explosive hazards. Phosphorus grenades that explode on impact, creating lots of noise, bright white light, have the drawback that they produce high levels of heat capable of inflicting severe burns.

Physiological disorientation occurs in response to a flashing or strobe light source. It is caused by the attempt of the eye to respond to rapid changes in light level or color. For on-and-off flashing, the pupil of the eye is continually constricting and relaxing in response to the contrasting light intensity reaching the eye. In addition, differing colors as well as differing light intensities cause the same effect. The disadvantage is epileptic fits may result and permanent neurological damage has been reported. The National Society for Epilepsy states "Around one in two hundred people have epilepsy and of these people only 3-5% have seizures induced by flashing lights. Photosensitivity is more common in children and adolescents and becomes less common from the mid twenties onwards."

Other devices such as electromagnetic weapons like the Vehicle-Mounted Active Denial System or VMADS being developed by Raytheon Missile Systems fires a focused, millimeter wave energy beam to induce an intolerable heating sensation. The energy penetrates less than 1/64 of an inch into the skin and the sensation ceases when the target moves out of the beam. Unfortunately, such a device does not incapacitate or disable the aggressor.

Thermal guns raise the agressor's body temperature to between 105 and 107 degrees Fahrenheit, creating an instant and incapacitating fever. The magnetophosphene gun can make a subject "see stars" by delivering what feels like a blow to the head. Such a device has the potential to do brain and bodily damage due to excessive heat.

Eye-Safe light laser security devices such as those described in U.S. Pat. Nos. 5,685,636 and 6,007,218 employ a single coherent light laser or bank of lasers as the light source. The laser can operate at any narrow wavelength band between 400 and 700 nanometers and provide either continuous or repetitively pulsed (on-off flashing) light. Although effective at stopping an aggressor, these types of non-lethal security devices could benefit from improvements in the areas of safety in use, overall effective, susceptibility to countermeasures, and cost. The disadvantage of coherent light lasers is that they produce a very narrow beam that is difficult to target and manage its intensity to avoid permanent eye damage. Furthermore the laser is susceptible to counter measures such as filtered goggles that are wave specific. A fixed laser wavelength has the added disadvantage of not shifting to correspond to the shift in sensitivity from day to night (Photopic curve to Scotopic curve).

Consequently there is a need in the industry for a non-lethal, visual security device that does not cause blindness or retinal damage, present a burn hazard, pose a fire or explosive hazard, cause seizures or brain damage, cause permanent harm to the target or others, that incapacitates the aggressor so that they may be easily apprehended, is capable of low cost manufacture, is relatively resistant to countermeasures, may be easily directed at one or more aggressors simultaneously, can incapacitate a target at great distances and renders the aggressor incapable of further aggression for a period of time to enable capture.

BRIEF SUMMARY OF THE INVENTION

It is an object of this invention to provide non-lethal, non-eye-damaging security devices based on intense light and, more particularly to provide non-lethal, non-damaging security devices using incoherent light to cause visual impairment and disorientation through illumination by constant focus reflected bright, visible light beams.

According to the present invention, a lamp assembly is provided including an outer housing with a handle for gripping by a user, the housing having a window opening for transmitting a light beam, a paraboloid reflector within the housing facing the window opening, a Xenon electric arc lamp or lamp mounted at the focus of the paraboloid reflector via an adjustment mechanism permitting precise positioning of the reflector, a high tension feed wire to the cathode end of the Xenon lamp, with the lamp electrode gap at the focus of the reflector, a power supply input for driving the lamp, and a cooling mechanism for maintaining constant optimum lamp anode temperature as desired. The spotlight also incorporates a safety switch, elapsed hour meter and low battery indicator light.

The electric arc lamp contains a Xenon gas which produces a high intensity light (plasma) ball. The adjustment mechanism relegates lamp tilt relative to the central axis of the reflector to the lamp manufacturer, and the reflector to be moved axially back and forth relative to the fixed plasma ball, until the focal position is found. This arrangement also permits stable focal adjustment with no added mechanical tolerancing. At this point the lamp is in position. These adjustments are made during or after manufacture of the spotlight.

In the preferred embodiment of the invention the power supply is connected to the lamp via electronic circuitry for controlling the lamp operation under precise conditions. This includes a substantially constant light output for an input voltage range continuously variable over 10.5 to 14.5 volts.

BRIEF DESCRIPTION OF THE SEVERAL VIEWS OF THE DRAWINGS

The present invention will be better understood from the following detailed description of a preferred embodiment of the invention, taken in conjunction with the accompanying drawings, in which like reference numerals refer to like parts, and in which.

DETAILED DESCRIPTION OF THE INVENTION

Figure 1A:
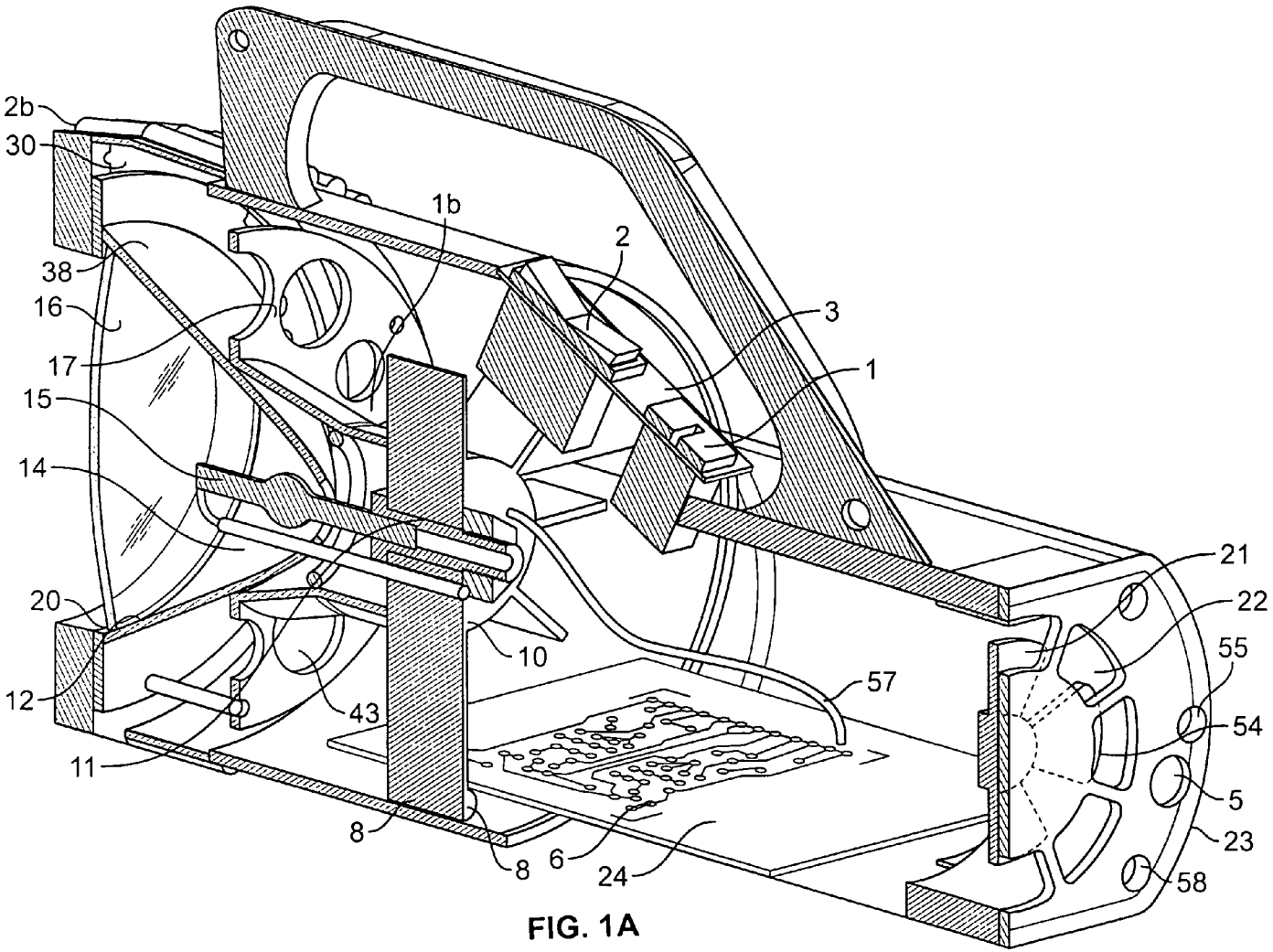
FIG. 1(A) is a side view of a spotlight assembly according to a preferred embodiment of the invention, (B) is a perspective view of a spotlight assembly partially broken away to illustrate the components of the spotlight.

Unless defined otherwise, all terms used herein have the same meaning as are commonly understood by one of skill in the art to which this invention belongs. All patents, patent applications and publications referred to throughout the disclosure herein are incorporated by reference in their entirety. In the event that there is a plurality of definitions for a term herein, those in this section prevail.

The term "incapacitating" as used herein refers to the capability of limiting the actions of a target by causing disorientation, reducing cognitive abilities, interfering with vision, and/or fine and gross motor skills for a period of time enabling capture or disarming of the target without the physical damage presently observed with coherent light source devices.

The term "adjustable mounting means" as used herein refers to any mounting configuration that allows the user to focus the beam of the electrical arc lamp to assure that the target at a given distance from the user receives sufficient intensity light to cause incapacitation.

The term "electrical circuit means" as used herein refers is any means by which the electric arc lamp may be activated in an effective and efficient manner to produce the desired affect on a target. Preferably the electronic circuit comprises at a minimum a switch connecting the power source to the electric arc lamp for turning the lamp on or off as desired. Other elements may be incorporated into the electronic circuit means to increase the effectiveness under certain anticipated or expected conditions. For example, the distance of a target may vary substantially. Under these circumstances it may be beneficial to incorporate an automatic focusing system for the beam to increase the chance of effectiveness. Such a system could include an Infrared range finder for determining the distance to a target allowing adjustment of the beam intensity prior to illumination to assure the desired affect is obtained on the target. Other mechanisms such as a mechanical shutter could be incorporated for pulsing the beam at the target.

The term "incoherent light" as used herein refers to light that is not produced from a coherent light source such as a laser. Ordinary light from the Sun or light bulbs consists mainly of light waves of many different wavelengths and is considered incoherent light. What light there is of the same wavelengths tends to be randomly phased as opposed to coherent light wherein the waves are in phase with each other.

The term "means for determining distance" as used herein refers to any means for estimating, approximating or determining the distance between two points wherein one point is the device utilizing the means for determining distance and the other point is the target. One example of such a device is an Infrared range finder.

The term "means for releasing" as used herein refers to any method that may be employed to release a beam of light from the device of the present invention in a single continuous blast, pulse or flash. One example of such a means would be a shutter affixed over the lens of the device that can be activated manually or electronically. Upon activation the louvers of the shutter are quickly rotated open and then rotated to the closed position to emit a beam of light at the target.

The present invention is a non-lethal, less-than-lethal, or less-lethal hand-held, mobile or stationary weapon that uses incoherent visible white light to temporarily disorient, stun, incapacitate, reduce the cognitive abilities of, or otherwise control and limit the actions of one or more persons, assailants, perpetrators, intruders, or adversaries, without causing permanent injury.

Figure 5:
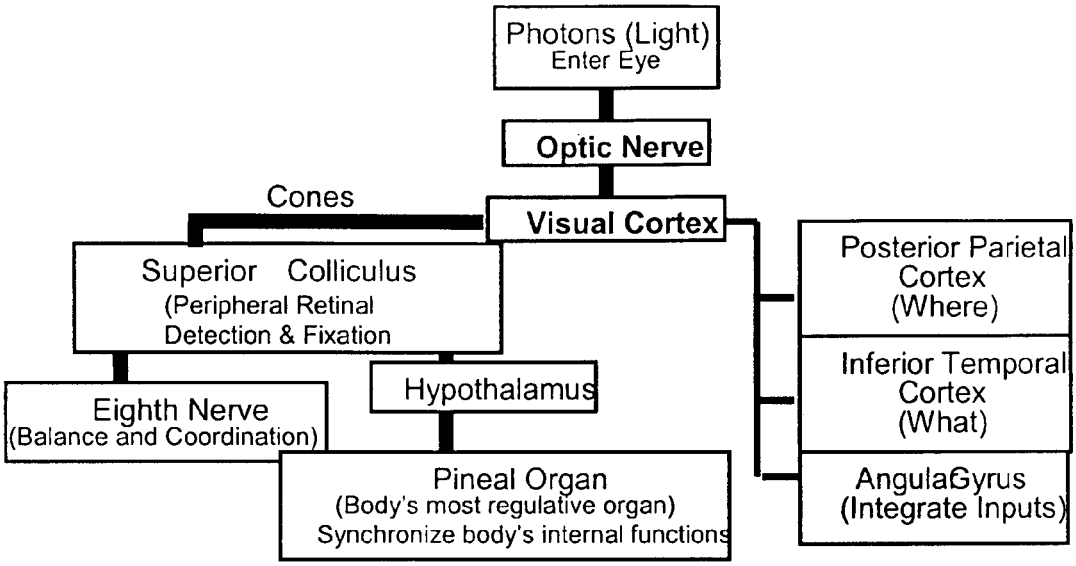
FIG. 5 is a schematic of the proposed physiological effect of the light on a target individual.

The invention produces luminous flux with sufficient photon content that, when applied to a target, enters the target's eyes and saturates the ocular retinal cones. It is postulated that this event produces a chemical reaction via the target's eighth nerve, possibly the pineal organ, posterior parietal cortex, inferior temporal cortex, and angular gyrus that temporarily disorients, stuns, incapacitates, reduces the cognitive abilities of a target, and otherwise controls and limits the actions of the target, including loss of control of fine and gross motor skills, without causing permanent injury to the target, as shown in FIG. 5.

The exact mechanism for the incapacitation is not fully understood, but appears to extend beyond the transient decrease in vision that occurs in individuals when they are subjected to a bright flash. There are more than 2 million neurons that comprise the optic nerve. They constitute about 40% of the total number of nerves entering or leaving the central nervous system via the cranial and spinal nerves. While the majority of the neural information is destined for the visual cortex, the visual system also provides a significant input for balance and muscle control. It is plausible that the incapacitation is the result of a sensory overload of the brain.

The incapacitating effect occurs within 2 seconds. The illuminated target is observed to temporarily lose the ability to see and to lose control of gross and fine motor skills for approximately 10 minutes with full recovery within 30 minutes. The result is disorientation and loss of balance effectively incapacitating the target(s). No physical damage to the visual system has been observed following exposure to a visible light source with appropriate intensity.

High Intensity Incoherent Light Assembly

Referring to FIGS. 1-4 the drawings illustrate a high intensity spotlight according to a preferred embodiment of the present invention. The spotlight is of a portable or hand held design and includes a outer, generally cylindrical casing of standard flashlight-like dimensions (for example, 6.5 inch head diameter×13 inch length) having a housing 1 in which electronic circuitry 6 for operating the spotlight is mounted, and an enlarged head portion X. The housing 1 also contains screw threads on the perimeter of it's head portion X for paraboloid reflector 38 positioning, a thermostatic switch, cooling fan 21, low battery indicator light 146, safety switch 145 and elapsed time meter 151.

Figure 1B:
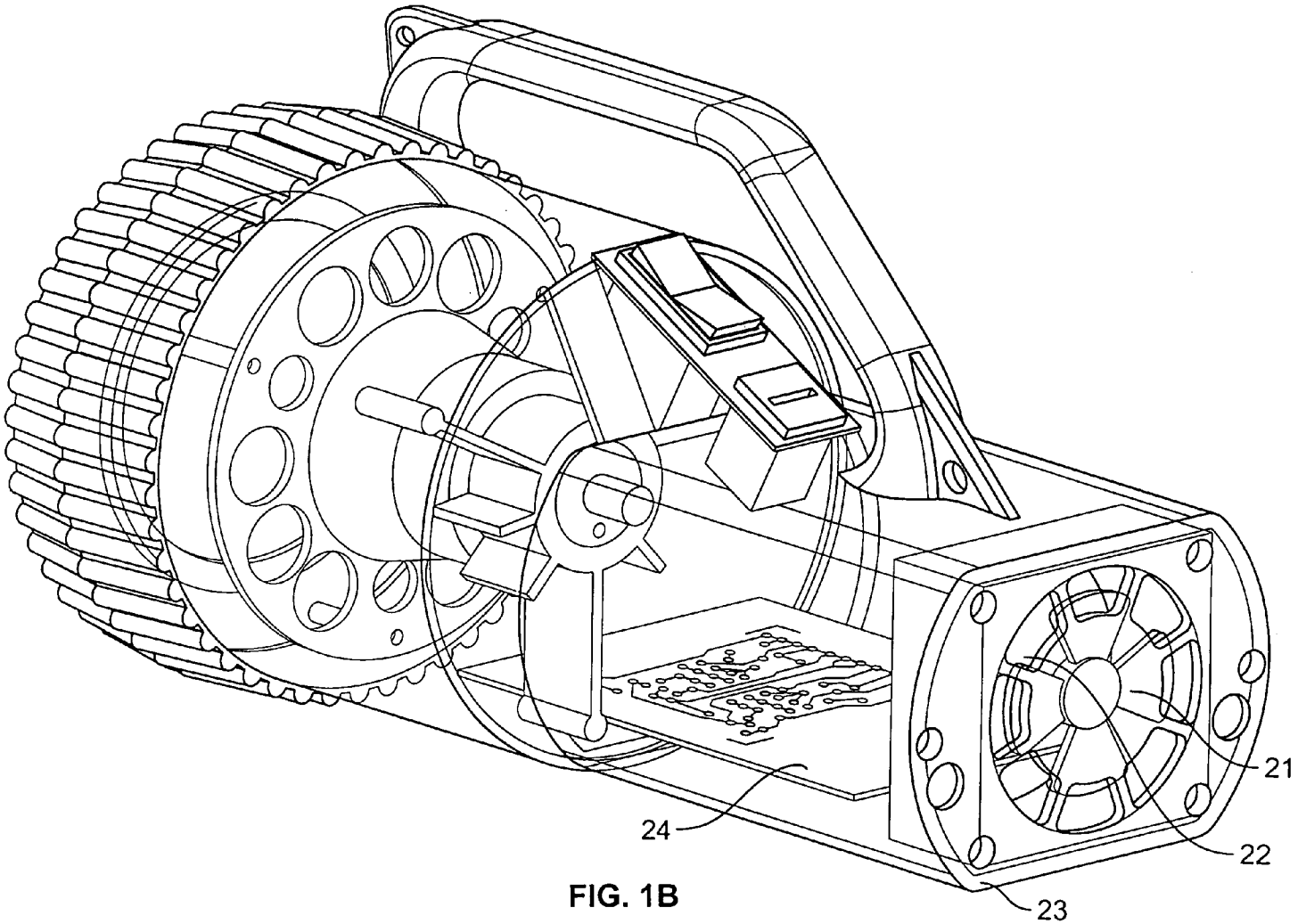

In one preferred embodiment of the present invention the housing is hollow and contains all the spotlight components. Referring to FIG. 1, The head portion X has a window lens 16 opening at its outer end for transmitting a light beam, and a paraboloid reflector 38 is mounted in the head portion X to face the window lens 16 opening. The paraboloid reflector 38 is preferably of electroformed nickel treated with highly reflective coatings like Aluminum-Quartz, Rhodium, or other dielectric thin film layers used to achieve desired absorption and reflectance properties. The paraboloid reflector 38 has an aperture 14 bored at its vertex for insertion of a Xenon arc lamp 15 and a cathode feed wire. The embodiment shown is the best method and can be scaled for higher power lamps. The 75-Watt Xenon arc lamp emits a beam through the window lens opening. The lens opening is preferably covered with a disc of specially coated glass 16 which is AR (anti-reflective) coated and has pre-determined properties to absorb ultraviolet light rays emitted by the Xenon arc lamp 15 below 400 nanometers wavelength which is harmful to the eyes (the UV screen is not required but is recommended for safety). The combination of AR Coating and reflector reflectivity results in converting ~1200 Lumens generated into a beam of ~1000 Lumens with a ~1 degree beam spread.

Figure 3:
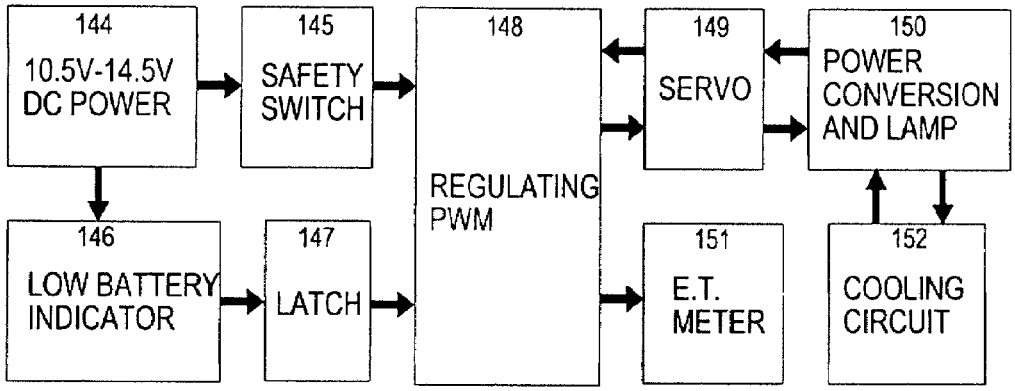
FIG. 3 is a block diagram of the electronic circuitry for the spotlight of FIGS. 1 and 2.

Referring to FIG. 3, The lens glass 16 is cradled in a U-channel gasket 27 that is secured in place by stand-off posts 37 (FIG. 4) and in contact with outer bezel 28 positioned over the window lens 16. Outer bezel 28 is threaded to the outer end of the housing head portion, and by turning the bezel 28 (and simultaneously the retainer threads), the unit is focused as the window lens gasket and paraboloid reflector 38 rotate together with respect to the stationary Xenon arc lamp 15.

Referring to FIG. 1, the paraboloid reflector 38 has an outer rim 13, which is seated against an annular shoulder 12 on the inner surface of the housing 1. Two 0-ring seals 41 and 42 ensure the paraboloid reflector 38 is under compression between the U-channel gasket 27, and reflector retainer 17. The base plate 10 has a central opening (larger diameter bore portion 49 and smaller diameter bore portion 52) in which collet 34 for Xenon arc lamp 15 is mounted via the collet nut 53.

Figure 4A:
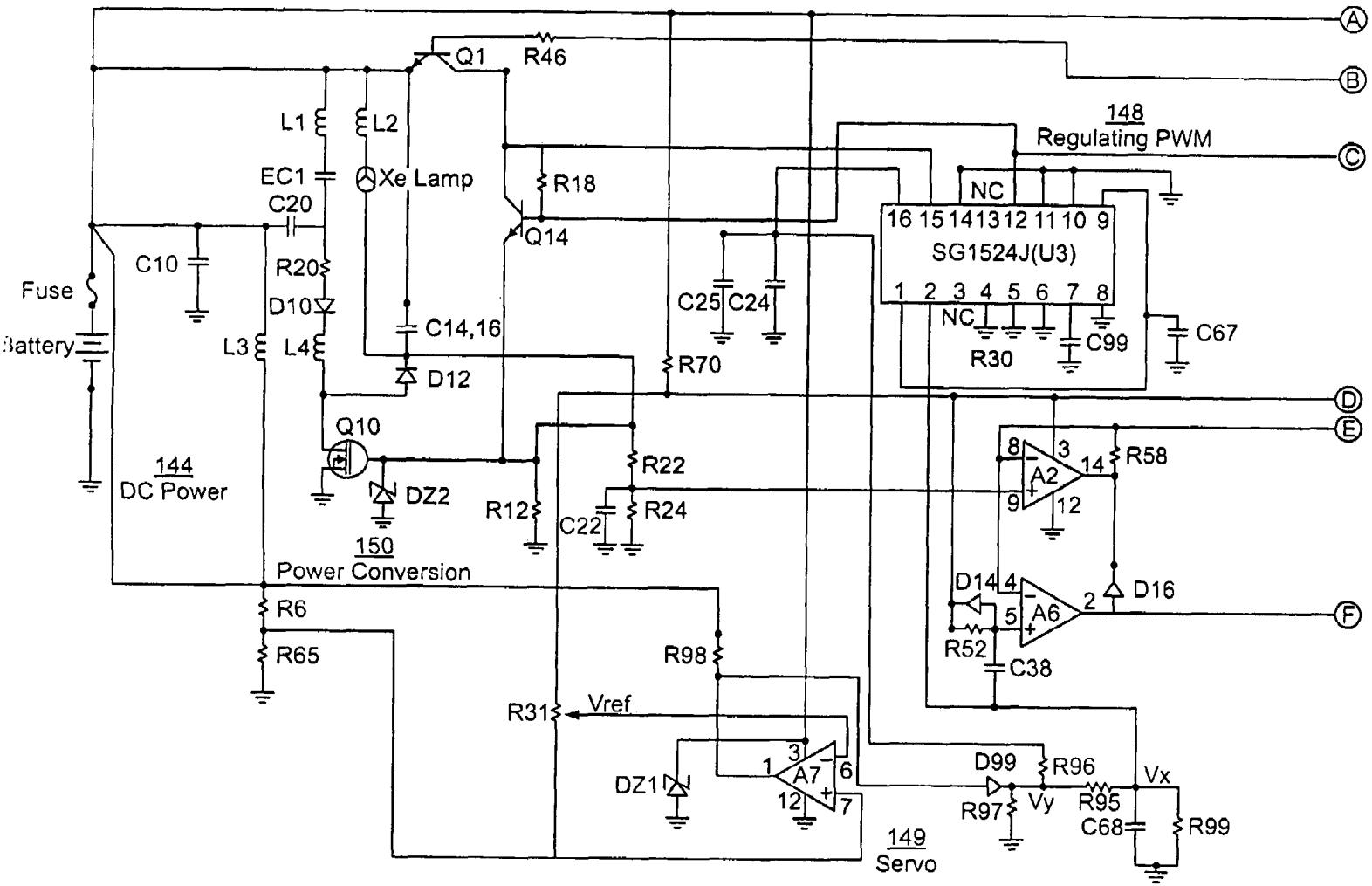
FIG. 4 is a schematic of one possible circuit configuration for the circuitry of FIG. 3.
Figure 4B:
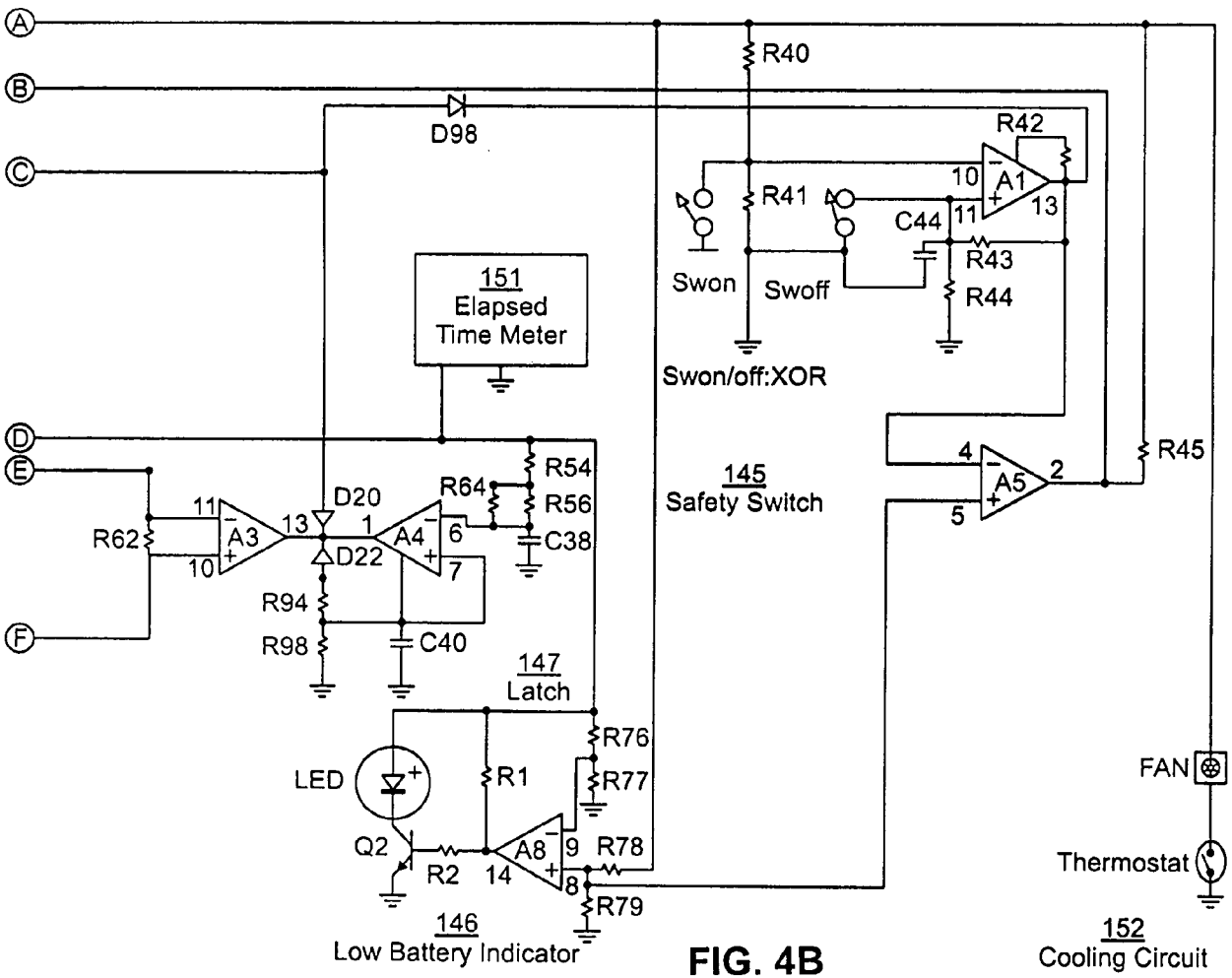

The base plate assembly 75 is in several parts, and is illustrated in more detail in FIG. 4. Assembly includes a reflector retainer 17 secured in the opening of the base plate 10 via threads (matching inner threads 45 and matching outer threads 46) of equal pitch to fastening clips 31. In this way, the reflector retainer 17 serves the purpose of a focusing mechanism for the Xenon arc lamp 15, and allows air to flow through air holes 43 for removing heat dissipated by the assembly 75 and reflector retainer 17 before exiting from air exit ports 30 of bezel 28. FIG. 4 shows connecting wire 39 threading glass capillary high temperature insulator 40, threading base plate assembly 75 through cathode wire feed-through hole 50, threading the reflector retainer 17 and paraboloid reflector 38 before being attached to the cathode connector 32 of Xenon arc lamp 15. The collet 34 has an outer chamfer 35 of conical outer diameter (and in which the anode portion of the lamp fits snugly). Mating seating surfaces on the assembly 75 accommodates mounting of the collet 34 through the larger diameter bore portion 49 with its threaded stem 36 projecting through the smaller diameter bore portion 52. Threaded stem 36 receives a similarly screw threaded collet nut 53 at its outer end in which the anode end of the Xenon arc lamp 33 is secured. Lens 16 is held by bezel 28 and U-channel gasket 27 with fastening clips 31, stand-off posts 37, screws (not shown) projecting through fastener holes 44 and attaching to threaded fastening clips 31; thereby compressing the reflector assembly against reflector O-ring 42, and the mating machined grooves for the O-ring, within reflector retainer 17.

Referring to FIG. 1, this mounting arrangement allows the position of the paraboloid reflector 38 relative to Xenon arc lamp 15 to be precisely adjusted, while allowing air flow across the spokes 9 and back side of the paraboloid reflector 38 and through air holes 43, before being exhausted through air exit ports 30 to the atmosphere. The paraboloid reflector 38 is moved axially in or out for longitudinal adjustment of the reflector position, by rotating the bezel 28 clockwise or anti-clockwise. The collet 34 can not be tilted in any direction for transverse adjustment; rather the axial symmetry of the lamp is relegated to the lamp manufacturer. Hence the focusing mechanism has minimal variation with time, temperature, shock, etc. The focusing adjustments are made during manufacture of the spotlight and then as needed by the user. The paraboloid reflector 38 position is adjusted until the gap between the electrodes is located precisely at the focus of the reflector, to produce a high candle power, tunnel-like beam of light, which is as close as possible to parallel, with little divergence. The optimum reflector position is detected by fixing the beam on a target, and (by rotating the bezel) adjusting the reflector position until the diameter of the spot is at a minimum.

Referring to FIGS. 1 and 4 the assembly 75 is designed with pre-determined mass and surface area to remove heat generated both by the Xenon arc lamp 15 and electrical circuitry. The assembly 75 is also designed to have the heat capacity and geometry required to achieve substantially constant anode temperature of approximately 185° C. Referring to FIGS. 4 and 6, assembly 75 has three mounting holes 47, 48 and 51 which hold power diode D12, thermal switch (thermostat) and transistor Q10. Thermostat switch is responsible for achieving the constant anode temperature of Xenon arc lamp 15 in conjunction with cooling fan 21 (see FIG. 2) and system pressure drop vs. air flow requirements for air entering housing 1 through air inlet ports 54, sucked through end cap 55 and filter material 22 by the cooling fan 21. Rear end cap 23 is secured through end cap holes 55 by two fastening screws (not shown), and the cooling fan 21 is fastened by screws (not shown) to the remaining four holes 56. The metal baseplate 10 holding the Xenon arc lamp 15 and collet 34 is of conductive material, for example aluminum. The aluminum must be massive enough to store sufficient heat, yet with enough surface area to dissipate heat generated. Referring to FIG. 1, the baseplate 10 also serves as the electrical connection to circuitry 6 using anode connecting wire 57.

The Xenon arc lamp 15 can be seen in more detail in FIGS. 1 and 4. The paraboloid reflector 38 is optimized for a 75 Watt Xenon arc lamp 15, collecting 90% of the light emitted at the reflector focus, while allowing only ~5% of the light emitted to pass through the hole at the vertex. Similarly, the length of the paraboloid reflector 38 is pre-determined to ideally collect 95% of the light reflected off the reflector. The optimum vertex hole size is ~14.0 mm diameter, with ~0.32 inch focal length and ~4-inch clear aperture; based upon the polar radiation plot for a Ushio (Cypress Calif.) UXL-75Xe short arc lamp. Another manufacturer's 75-Watt Xenon arc lamp could be used instead, but the radiation pattern will be somewhat different. For example, Osram-Sylvania (Danvers Mass.), Philips (New York, N.Y.) and many other manufacturers make similar 75 Watt and higher (more than 4000 Watts) Xenon arc lamps.

As mentioned above, the anode connection to the power supply and electronic or control circuitry 6 is made via base plate 10. Referring to FIG. 4, The cathode connection is made via conductive end cathode clip 32 on the distal end of the Xenon arc lamp which is secured via conductive connecting wire 39, through glass capillary insulating tube 40, and through cathode wire feed-through hole 50 in the baseplate 10, where it connects to the power supply circuitry shown in FIGS. 5 and 6. Cathode end clip 32 has some resilience to produce a spring effect, while welding the connecting wire 39 to the lamp cathode clip 32 achieves a reliable connection. The conductive connecting wire 39 is flexible to avoid any mounting torque on the cantilevered end of the lamp (cathode remains free from strain). Conductive connecting wire 39 is coated with flexible insulation to withstand a ~12 kV ~0.5-microsecond voltage pulse in the empty space between the conductive connecting wire 39, and hole at vertex of paraboloid reflector 14 shown in FIG. 1 (insulation thickness may be increased for higher wattage Xenon arc lamps requiring larger peak starting voltages). Conductive connecting wire 39 is coated by flexible insulation which can withstand temperatures in excess of 200° C. continuously. In the event of impact or vibration, the cathode end of the lamp can vibrate with less risk of damage. For 75-Watt Xenon arc lamps, a length of nickel wire 58 surrounds the length of the lamp to improve the lamp starting performance and stability of the ensuing arc by serving as an equipotential with magnetic susceptibility. Large Xenon arc lamps (i.e. 2500 Watts) may need an externally applied magnetic field in place of the nickel wire 58 for stable operation. The Xenon arc lamp has only a very short gap 59 between its electrodes, normally on the order of 0.8 millimeters for a 75 Watt lamp (and for reference, 3 mm for a 1000 Watt lamp), and it is this gap which is centered on the focus of the reflector in order to achieve the desired, substantially parallel, high intensity light beam.

Figure 2:
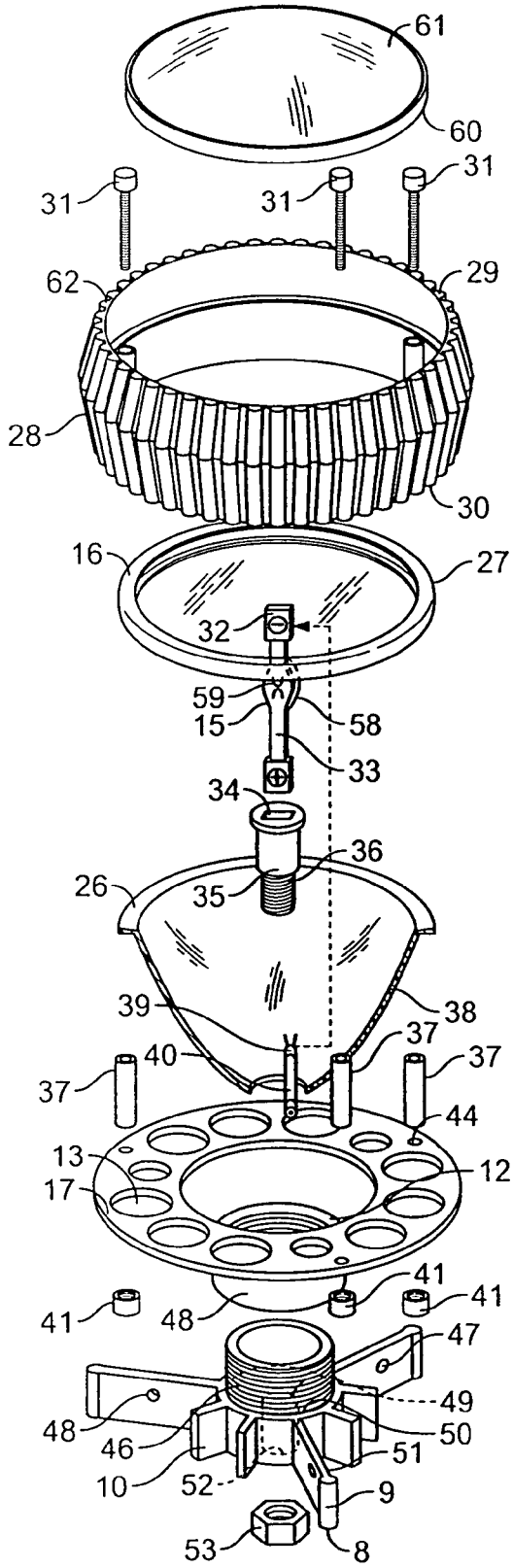
FIG. 2 is an exploded view of the spotlight's focusing and front section assembly mechanism.

As illustrated in FIG. 2, the housing 1 comprises a hollow tubular member and contains the cooling fan 21 and printed circuit board 24, containing all electronic circuitry described in FIGS. 3 and 4 for operating the 75-Watt Xenon arc lamp under precisely controlled conditions, as explained in more detail below. The housing 1 has air inlet and exit ports 54 and 30 (FIG. 1) where coolant air cycles through the system to remove heat from the baseplate 10 and paraboloid reflector 38 surfaces while keeping the lamp anode 33 at substantially constant 180° C. Referring to FIG. 2, the circuit components are provided on printed circuit board 24 mounted in the casing 1. Referring to FIG. 1, a thumb switch 2 is imprinted for the user to read "Off-On-Start" which can initiate and then terminate operation of the circuitry to activate the lamp at the push of a button. The switch 2 also protects against the circuitry from igniting the lamp when it is first plugged into the battery if the switch has been left in the "On" position. The switch 2 has three physical positions "Off", "On" and "Momentary-On" (START).

Referring to FIG. 2, detachable end cap 23 seals the back end of the casing 1 while retaining cooling fan 21 and filter material 22. Removable front end cap 29 (see FIG. 3) seals the front end of the casing 1 to attenuate high frequency radiation generated by the Xenon arc lamp 15 during ignition transients. Referring to FIG. 1, a power cord hole 5 exists in the end cap 23 for receiving power to operate the unit, from an (15-Ampere Slo-Blo fused) automobile cigarette lighter, external 12-Volt battery power pack, or a 10.5V-14.5V power supply for example. A cord strain relief connection (not shown) holds the power cord snugly through power cord hole 5.

The inner wall of the casing 1 is coated with an electroplated shielding along its whole length, for attenuating the radiation generated by the electronic circuitry 6. Radiation generated by the Xenon arc lamp 15 during ignition is attenuated by conductive end cap 23 of FIG. 2. Referring to FIG. 1, the casing 1 also contains means for connecting to the casing the Spyder spokes 9, an elapsed time meter 4, a low battery indicator light 3, and cooling fan 21 of FIG. 2. The casing has two grooves or snap-in channels 29 on its inside opposing sides into which the printed circuit board 24 is press-fit to the opposite side edges of the casing 1 to secure it in place. Spaced buckle holes may be mounted on the outside of the housing for receiving a shoulder strap (not illustrated) for carrying the spotlight. The shape of the housing 1 maybe such that it prevents rolling of the housing if the spotlight is placed on a flat surface. There may be two threaded holes on the side of the housing used to attach the spotlight to a yoke (not shown). There may also be a threaded hole on the bottom of the housing to attach a camera or gun mount (not shown).

The circuitry for controlling operation of the Xenon arc lamp will now be described in more detail with reference to FIGS. 3 and 4.

Referring first to the block diagram of FIG. 3, the circuit for a 75-Watt Xenon arc lamp 15 has suitable 10.5-14.5 Volt power supply 144, which is connected via power cord hole 5 (see FIG. 1) and which may comprise a battery, a vehicle lighter, or a power converter from a wall socket, for example.

The circuit shown in FIGS. 3 and 4 provides a substantially constant power to a 75-Watt Xenon arc lamp 15 for a plurality of input voltages. The power delivered to the lamp is under control of a servo loop 149. The intent is to allow for operation from a 12-volt battery (e.g. Lead-acid Nickel-Cadmium, or Lithium-ion), or from an automobile charging system which typically operates between about 10.0 and 14.2 Volts. Usage of Nickel-Cadmium (Ni—Cd) batteries are not recommended for reliable operation of the low battery indication because Ni—Cd batteries have a more constant output voltage than the lead acid type during discharge. The lamp is programmed to shut-down when the circuit input voltage drops below 10.5 Volts in order to protect the battery from damage. The cable which connects the battery to the device has low resistance. A practical battery connection extends above 50 feet with one Volt average drop across a 14-gauge stranded copper wire pair. 5 feet of 16-gauge wire also corresponds to 1 volt drop across the power cable during steady operation of the lamp.

Modes of Operation

There are several modes of operation to be described which are outlined below generally in the order, which they occur:

1. Connecting the battery
2. Engaging the on/off switch
3. Spark gap discharge and lamp ignition
4. Servo loop stabilization
5. Thermal management and cooling
6. Low battery detection and shutdown
7. Automatic shutdown upon lamp failure
8. Average lamp power and operating frequency adjustment
9. Safety switch
10. Low battery indicator
11. Elapsed time meter Mode 1. Connecting the Battery.

It is assumed that the circuit is fully discharged before the battery is connected. Referring to FIG. 4, it is also assumed that the on/off switch is in the "off" ($SW_{on}$ open, $SW_{off}$ closed) position when the battery is connected to the circuit. Upon connection of the battery to the circuit, capacitor C10 charges up to the battery voltage. C10 is a relatively large capacitance for supplying filtered current to the power switching transistor Q10. Because the on/off switch is in the open position, the base-to-emitter voltage of the Q10 remains low so no current flows, and the collector of Q10 stands off the battery voltage. The cooling circuit 152 remains powered up even when the switch is turned off.

Mode 2. Engaging the on/off Switch to Turn on the Light.

U3 (the regulating pulse-width-modulator (PWM) is a well-known integrated circuit such as the LT/SG1524. When the switch is first turned on, the regulator output (U3 pin 16) tends quickly toward 5 Volts and charges filtering capacitors C24, C25. Before pin 16 of the PWM reaches 5 Volts however, its oscillator has not yet begun so consequently pin 12 of U3 is initially in a high impedance state. Initially, open-collector output pins 1,13 of U1 are at high impedance. Before the PWM starts to oscillate, a current conducts through R18. The collector current rise time of Q14 is initially slowed by Resistor R69-C69 which prevents excessive current through Q10 until the PWM begins oscillating. When the voltage on pin 16 of the PWM finally rises to 5 Volts, the servo 149 and latch 147 can then engage. A voltage at pin 2 of U3 controls the duty cycle of it's output at pin 12. The voltage at pin 2 initially achieves it's minimum value determined by voltage divider R96, R97. A minimum value at PWM pin 2 corresponds to a maximum duty cycle. Thus upon startup (when oscillation begins), maximum duty cycle is applied to the base of Q10 to assist in starting the lamp.

Initially the latch 147 is held in the "off" position as defined by high impedance at pins 1,13 of quad comparator U1. U1 is comprised of operational amplifiers A2, A3, A4 and A6. During ignition and before the Xenon arc lamp is ignited, the voltage at pin 7 of U1 remains greater than the voltage at U1 pin 6, due to the difference in time constants R64-C38 and R70-R68-C40. Also during startup the voltage at pin 10 of U1 remains less than the 2.5V setpoint voltage at pin 11 of comparator U1 (R54-R56). The effect is for the output (U1 pin 13) to remain at high impedance (off) until several seconds have elapsed after the on/off switch was engaged. If the lamp still has not ignited after the time determined by R52-C36, then the latch output will switch to low impedance at pins 1,13 when pin 2 of U1 goes high (5V) after time constant R52-C36 has elapsed and the lamp still has not ignited. During ignition, U1 pin 14 goes high. If the lamp ignites, U1 pin 14 goes low. If U1 pin 2 goes high due to R52-C36 time constant before U1 pin 14 goes low (lamp started) then the latch 147 will "set" and disable the lamp while placing the circuit on standby after C40 discharges to near zero exit Volts. Low impedance at pin 1,13 of U1 disables the PWM (and the power transistor Q10) by shunting the output of U3 pin 12 to ground through D20. Subsequently, a low value at U1 pin 13 prevents lamp ignition until after the thumb switch has been shut off.

Mode 3. Spark-Gap Discharge and Lamp Ignition.

When the lamp has not yet ignited, capacitor C14 is charged to ~100 Volts through inductor L3 and rectifier D12 as follows: When Q10 conducts, current rises in L3 and flows to ground through the collector of Q10 for the "on" portion of the duty cycle determined by the PWM 148. When the PWM changes to it's "off" portion, transistor Q10 turns off thus forcing current flowing through L3 to divert into C14 through diode D12. Since the Xenon arc lamp is not conducting, negligible current flows into the lamp as capacitor C14 continues charging toward ~100V.

Concurrently, as the lamp has not yet ignited, capacitor C20 charges through diode D10 and current limiting resistor R20 using the magnetic coupling and turns ratio of L3-L4. When the voltage across C20 exceeds 470V, spark gap EC1 arcs-over, providing a ~0.5 us FWHM, low-impedance discharge of 2500 Amperes peak, chiefly due to the series impedance of capacitor C20, spark gap EC1 and transformer winding L1. The fast discharge of C20 through L1 and EC1 causes −12 kV to be applied across the lamp electrodes due to the magnetic coupling and turns ratio of L1-L2. When −12 kV appears at the lamp cathode, the Xenon gas becomes ionized at approximately 10~50 Amperes, 12 kV and then capacitor C14 discharges through the lamp. The initial ~500 kW discharge of C14 into the lamp provides necessary cathode heating to sustain an arc. With the arc sustained, the lamp drops to a low impedance state and peak collector voltage across Q10 drops significantly from 110V to 55V. Thereafter a 55V peak on Q10's collector during steady state lamp operation only charges C20 to 350 Volts, which is well below the arc-over threshold of EC1. Hence as soon as the lamp ignites, the 470 Volt spark gap EC1 can not fire again. A properly working circuit generates only one high power −12 kV ignition pulse at the Xenon arc lamp cathode before it ignites. If the lamp does not ignite on the first pulse (due to wear and temperature), the collector of Q10 will remain at 110V peak until a) the lamp ignites or b) the latch sets (thereby placing the spotlight on standby) after unsuccessful ignition of the lamp over a few seconds time at a pulsed ignition rep-rate of approximately 3~10 Hz. When the lamp is not conducting and the peak collector voltage of Q1 is at 110V the voltage at pin 9 of U1 becomes greater than the 2.5V setpoint at U1 pin 8 as described above, which will cause the latch 147 to be set if the few-second time constant of R52-C36 has elapsed and the lamp has not yet ignited. If lamp does ignite, the reduction of 110V peak collector voltage to 55 Volts peak brings pin 9 of U1 below the 2.5V setpoint (U1 pin 8) so pin 10 of LM393 remains low and the latch 147 does not set.

During steady state operation when the lamp is on, the 20 KHz periodic behavior is as follows: prior to pin 12 of U3 going high (during the "on" portion of it's duty cycle), Q10 is not conducting. When Q10 is not conducting, the lamp current source is due to monotonically decreasing series current flowing through L3 and D12. The current flowing through D12 splits and flows into the lamp while simultaneously re-charging capacitor C14. As soon as capacitor C14 is fully charged, the PWM transitions to it's "on" cycle (U3 pin 12 goes high) and transistor Q10 shunts the current flowing through L3-D12 to ground through the collector of Q10. The series current through L3, Q10 begins to rise monotonically as energy is stored in the magnetic field of L3 for delivery to the lamp and C14 during the next half-cycle. Simultaneously when the current through inductor L3 increases, the voltage across capacitor C14 decreases when it is delivering current to the lamp (as D12 is reverse biased during that time interval). As C14 is decreasing in voltage during the PWM "on" cycle, inductor L2 provides a substantially constant, 6 Ampere peak current with only 0.5 peak Amperes current change through the lamp. As U3 pin 12 reaches the end of it's "on" cycle, series current through L3, Q10 reaches ~22 Amperes. Concurrently, capacitor C14 is discharged and diode D12 becomes forward biased which begins to divert current away from the collector of Q10 even before U3 pin 12 goes into it's "low" half cycle and cuts off base current to the Q10. At this point the process begins again with the current through L3 monotonically decreasing as it delivers energy to the lamp and C14. The switching cycle repeats at approximately 20 KHz to achieve constant 80 Watts average lamp power. Higher operating frequencies translate to more power loss in the circuitry, where lower operating frequencies are in the range of human hearing and mechanical camera shutter speeds. It should be noted that a power MOSFET, IGBT, GTO or other power switch could be substituted for the Darlington transistor pair Q12, Q10 in order to reduce conduction and switching losses; with minimal changes to the circuit.

Mode 4. Servo Loop Stabilization.

Referring to FIG. 4, when the lamp has ignited, the servo senses the voltage $V_z$ generated at the collector of Q10 with voltage divider R6-R65. The servo compares the voltage $V_z$ against the setpoint $V_{ref}$ and then integrates the resulting comparison pulses to increase or decrease the duty cycle of the PWM. Ideally the peak voltage across Q10 is 55 Volts which yields an average lamp power of ~80 Watts. If the peak voltage at the collector of Q10 remains at 55 Volts when the input power supply voltage is in the range 10.5V-14.5V then the average lamp power remains substantially constant (nominally within 5% of its mean at 20 KHz, but can be made arbitrarily small by increasing the value of L2). The control loop input voltage $V_z$ is compared with $V_{ref}$, which then generates a square wave pulse at pin 1 of quad comparator U2 (assuming the PWM is in operation and the latch is off with U1 pin 13 high). U2 is comprised of operational amplifiers A1, A5, A7 and A8. The square pulse at pin 1 of U2 is divided by the combination of resistors R96,R97, and R98 so the voltage $V_y$ remains within the PWM's useful range of input voltages 2.5V-3.5V (the PWM input at pin 2 responds to the range of 2.5V-3.5V). Resistor R95 and capacitor C68 filter the signal $V_y$ so a DC level $V_x$ is generated and applied to the duty cycle adjustment pin 2 of the PWM (U3). Resistor R99 provides a discharge path for C68, which makes the circuit less sensitive to probing for measurement purposes. The resulting electrical feedback (servo) process causes the duty cycle to vary from maximum to minimum as the circuit input voltage respectively varies from minimum to maximum.

Mode 5. Thermal Management and Cooling.

There are three devices, which dissipate relatively large amounts of heat when the 75-Watt lamp is on: the lamp, transistor Q10 and power diode D12. Q10 and D12 together generate 25 Watts of heat, while the Xenon arc lamp also generates more than 25 Watts of heat. Therefore at least Watts of heat is required to be dissipated by the baseplate 10 when the Xenon arc lamp 15 is delivered with a constant power of 80 Watts. It is also required to maintain the baseplate 10 temperature at a level corresponding to a lamp anode temperature of approximately 185° C. Since the thermostat switch is connected to the baseplate 10 mounting hole 51 (FIG. 4), it senses a pre-determined temperature window of on and off temperatures. The thermostat powers the fan 21 directly from the battery so it will operate independently of the on/off switch. If the lamp is shut off then the fan circuit will continue to operate until either the lamp anode temperature decreases below ~180° C. as sensed by the thermostat or if the battery becomes disconnected. The fan will operate when the thermostat switch reaches an equivalent anode temperature Ton ~190° C. and the fan will shut off automatically when the thermostatic switch cools to an equivalent anode temperature $T_{off}$~180° C. Since the thermostat is mounted in a predetermined position for sensing a proportionate temperature to the Xenon arc lamp anode, the thermostat senses a corresponding lamp temperature, and turns the fan on to blow air across the baseplate (heat sink) as needed. As the baseplate cools from the fan air blowing on it, the attached thermostat switch cools back toward temperature $T_{off}$. When the lamp is off, the fan will cool the baseplate faster than when the lamp is on.

Mode 6. Low Battery Detection and Shutdown.

Rechargeable batteries can degrade in performance if allowed to deep-discharge. Deep-discharge is defined here to be below ~10.5 Volts for a 12 Volt, 12 Amp-Hour rechargeable battery sourcing 13 Amperes. Thus to stay well above deep discharge the latch 147 (pin 1 of U1) sets and its output drops to low impedance if circuit input voltage drops below ~9.5 volts (accounting for ~1 volt drop across the power cord during steady state operation), and the output of the PWM (U3 pin 12) is shunted to ground through D20 when the latch 147 is set. Also when the latch sets (U1 pin 1 goes low), and C40 discharges to ground through R94-D22. Once the latch is set, the lamp can not re-start until the on/off switch is momentarily disengaged to the "off" position and then re-engaged to the "on" and then "start" position. When the on/off switch has been turned "off", C36 discharges through D14, R31 to ground. Therefore the lamp can not be turned on and off too rapidly by the thumb switch faster than approximately one time constant of the R31-C36 resistor-capacitor pair.

Mode 7. Automatic Shutdown Upon Lamp Failure.

There is a chance that a Xenon arc lamp will explode under certain conditions and become an electrical open-circuit. There is also a possibility for a lamp electrode to become detached due to shock or electrical contact failure. If such a condition should happen while the lamp is on then the peak collector voltage of Q10 increases from 55V peak to its maximum peak value of 110V. The spark gap EC1 would then begin firing at approximately 3-10 Hz repitition-rate until the time constant R22-C22 charges C22 and U1 pin 9 exceeds the 2.5V setpoint at U1 pin 8. Since many time constants R52-C36 elapse after the lamp has reached steady state operation, the latch immediately sets and puts the spotlight on standby if a lamp connection is interrupted; since U1 pin 14 goes high (due to the 110V peak collector voltage of the Q10) which sets the latch 147 (U1 pin 1) low and puts the spotlight on standby.

Mode 8. Average Lamp Power and Frequency Adjustment.

The voltage $V_{ref}$ set by R31 determines the average output power delivered to the lamp during steady state operation. $V_{ref}$ is adjusted to ~1.25V to maintain a constant 80 Watts delivered to the lamp. The operating frequency of the PWM U3 is set by R30 and C99 on the PWM (pins 6,7 of U3). The frequency is set high enough to be out of range of human hearing, yet low enough to reduce magnetically induced core energy losses in L1-L2 and L3-L4. Since the frequency is relatively high at 20 kHz, the 10% variation from the average power delivered to the lamp (per switching cycle) is neither detectable by the human eye, or by mechanical camera shutters whose shutter speed is limited to about 1 millisecond. C67 connects to pin 9 of U3, and is compensation capacitance to prevent a glitch on the PWM output.

Precise positioning of the arc at the focal point of the paraboloid reflector produces a high intensity, high range, substantially parallel beam of light which is essentially a portable spotlight with a 1 degree beam divergence; emitting ~1000 Lumens of the ~1200 Lumens generated by the xenon arc lamp (total lumens of visible light in the range 380 nm-780 nm) from a 4-inch diameter clear aperture. The beam is of long range, typically as far as the eye can see; to enable the user to see objects at a distance under reduced light conditions or darkness. The range of the lamp is typically greater than one mile, and it has an intensity great enough to read when the spotlight is illuminating a newspaper over your shoulder (in total darkness) from a distance of one mile. In addition to being portable, the spotlight produces a beam, which will penetrate fog and smoke by using an amber filter. An infrared filter allows for night vision applications in the infrared (non-visible) range. The spotlight can be powered from any convenient 10.5-14.5 Volt battery source, such as an automobile having a 12 Volt cigar lighter.

Mode 9. Safety Switch.

In order to protect the user from inadvertently leaving the thumb switch in the "on" position and igniting the lamp during connection of the battery cable, a safety circuit has been included which prevents inadvertent ignition. The safety switch can be left on, and to ignite the lamp, it must be pressed to the "Start" position manually by the user. The switch also has an "Off" position for added protection. Referring to FIG. 4, a mechanical thumb switch for OFF-NONE-MOMENTARY ON operation represents $SW_{on}$ and $SW_{off}$ ($SW_{on}$ or $SW_{off}$ can be closed connections, but not both at the same time). U2 pin 13 is a secondary latch that resets low anytime the battery is plugged in; disabling the power supply and PWM U3. When pin 13 of U2 goes high due to engaging the switch to "start", the safety switch circuitry 145 bootstraps the PWM 148 and servo 149 into operation. When a battery is first connected to the circuit (with thumb switch in either "Off" or "Run" position), the safety switch circuit 145 sees voltage Vcc as the input voltage of U2 pin 3. When the battery is first connected, pin 10 of U2 becomes Vcc/3.2, while pin 11 of U2 stays at zero. Since the voltage at pin 10 is greater than the voltage at pin 11 the output pin 13 of U2 is in the low impedance state and the voltage at U2 pin 13 remains near zero. Capacitor C44 in conjunction with resistors R42,R43, and R44 delays the onset of voltage to U2 pin 11 when the battery is first connected; which assures pin 11 of U2 stays near zero during any transients generated during battery connection. Once steady state has been achieved (when the lamp is still off) in the short time before the user is able to turn the power switch on, U2 pin 2 is high as U2 pin 5 is at a voltage determined by R78,R79 and U2 pin 4 is low as described previously. With U2 pin 2 in the high impedance state, it keeps the transistor Q1 in cut-off so no collector current flows and the PWM remains without power. To then turn the lamp on, $SW_{off}$ is disengaged by moving the thumb switch and U2 pin 11 remains at zero volts when the thumb switch is in the no contact ("None," or "Run") thumb switch position.

When the user finally pushes the thumb switch to the "Start" position, $SW_{on}$ engages and causes U2 pin 10 to become near zero, less than U2 pin 11, subsequently U2 pin 2 goes high as the small voltage at pin 11 becomes relatively large; although still being only millivolts. This voltage differential causes U2 pin 13 to attain 2*Vcc/3 which is both large enough to prevent forward conduction of D98 when the PWM is operating, and for U2 pin 2 to go low. As soon as U2 pin 2 goes low, a base current flows through R46 thereby enabling current flow into the PWM pin 15 from the collector of Q1 and subsequent lamp ignition as described in part 3 above. During operation of the lamp, when the switch is in the "Run" position U2 pin 10 remains at Vcc/3.2 and U2 pin 11 remains at Vcc/3 hence the lamp continues to operate normally. During operation of the lamp, when the switch is depressed to the "Start" position, the spark gap EC1 can not fire as described above, so no ignition will occur. Only by depressing the thumb switch to the "Off" position (when U2 pin 11 goes low) can the output U2 pin 13 go low to disable the lamp by terminating power to U3 pin 15 (when U2 pin 2 goes high). When the lamp has been shut off, the thumb switch can again be switched to the "Run" and then "Start" positions to restart the lamp as described.

Mode 10. Low Battery Indicator Light.

During steady state operation, the PWM produces a regulated 5 Volts which appears at U2 pin 9 as 2.5 Volts using R76-R77. If the voltage at pin 8 of U2 decreases below 2.5 Volts, then U2 pin 14 will go high and thereby provide base current to Q2 via resistor R02 and pull-up resistor R01. The base current into Q2 lights LED which has an internal current limiting resistor. Using a 12V, 12 Amp-Hour lead acid battery sourcing 8-12 Amperes, it was found that the indicator lamp remains on for ~5 minutes before the battery voltage becomes low enough to trigger the discharge of C40 into pin 1 of U1; thereby disabling the PWM output U3 pin 12 and shutting off the lamp. When the battery is first connected, the LED will be disabled as the Voltage at U2 pin 9 remains zero until the thumb switch is engaged to bootstrap U3.

Mode 11. Elapsed Time Meter.

The elapsed time meter described in FIGS. 5 and 6 runs whenever the PWM 148 is powered up. When 400 hours has elapsed, the user can replace both the elapsed time meter and the lamp. Continued usage beyond 400 hours presents an increased risk of lamp explosion and collateral damage to the reflector and lens.

Although a preferred embodiment of the invention for a 75-Watt Xenon arc lamp (and Xenon lamps in general) has been described above by way of example only, it will be understood by those skilled in the art that modifications may be made to the disclosed embodiment without departing from the scope of the invention, which is defined by the appended claims.

The light from the device has been observed to cause a temporary stunning effect. This stunning effect occurs within 2 seconds: the illuminated subject is observed to temporarily lose the ability to see and to lose control of gross and fine motor skills for approximately 10 minutes with full recovery within 30 minutes. The result is disorientation and loss of balance effectively incapacitating the subject(s). No physical damage to the visual system has been observed following exposure to the light source.

The exact mechanism for the incapacitation is novel and appears to extend beyond the transient decrease in vision that occurs in individuals when they are subjected to the bright flash. There are more than 2 million neurons that comprise the optic nerve. They constitute about 40% of the total number of nerves entering or leaving the central nervous system via the cranial and spinal nerves. While the majority of the neural information is destined for the visual cortex, the visual system also provides a significant input for balance and muscle control. It is plausible that the incapacitation is the result of a sensory overload of the brain.

Range Finder

A commercially available Infrared-based range finder may be interfaced with the device of the present invention to increase its efficiency and effectiveness. For example the LDM 301 (West Palm Beach, Fla.) or LRM Mod 2/2CI (Newcon Optik, Toronto, Ontario) may be utilized in conjunction with the present invention. In one embodiment, the range finder may output an analog voltage that is directly proportional to range that would be used as the input to the device's power conversion and control electronics. Alternatively, the interface between the range finder and the power conversion and control electronics may be accomplished via a serial communication standard, such as EIA-485, or similar.

Adjustable Lamp Power Control

It would be beneficial to be able to adjust the amount of power provided to the lamp in circumstances where a target or targets may occur at variable distances from the user. Increasing power to deliver an appropriate blast or flash at a distance to assure incapacitation or decreasing the power during close proximity uses to save energy would increase both efficiency and effectiveness. The power conversion and control electronics consists of electronic circuitry that controls the operation of the lamp. The three primary functions of the circuitry are lamp start, regulation of power during lamp operation, and lamp shut down. In one embodiment, the power input to the lamp is constant. In a preferred embodiment the power input to the lamp may be varied based on the output of the range finder. The capability to vary the intensity of the visible light output, as a function of range to the target and the optical beam width will be performed by inputting an analog voltage output from the rangefinder into the device's power conversion and control electronics. Alternatively, the interface between the range finder and the power conversion and control electronics may be accomplished via a serial communication standard, such as EIA-485, or similar.

Shutter

The activation and full high intensity illumination capability from an arc lamp can take a moment after the arc has been initiated, consequently when initiating a blast or flash it is preferable to have the lamp in its fully operational state before use. Therefore, during acquisition of the target, a lens filter can be placed over the lamp lens to spectrally limit its output to the near infrared. During illumination, this lens filter can be removed, allowing the full visible spectrum illumination by the lamp. In order for the target to be surprised, the lens filter must be removed rapidly. This could be accomplished mechanically, using a fast acting shutter.

Alternatively, a separate Infrared only source could be used for the range finder function. In that case, a shutter similar to that used in a camera could be utilized.

Operation

In one preferred embodiment the device of the present invention consists of a Xenon short-arc lamp and associated optical components, a target ranging subsystem and a power conversion and control electronics subsystem. If the system is to be utilized at night it is preferable that night vision goggles be worn to more easily identify targets.

The device will produce 3 million average candlepower of incoherent luminous intensity in a tightly focused 1-degree beam that extends for a distance that can exceed one mile. The beam can be adjusted as described above to provide a 10-degree beam spread that provides an 885-foot diameter beam at 5,000 feet. Functionally, the operation of the device consists of target acquisition, range finding, and illumination, generally in sequence.

During operation the device is turned on and a particular target acquisition area is then surveyed to select a target or targets. A detachable orange or black (870 or 980 nm) filter may be attached to the device, to provide enhanced illumination for fog or night conditions, respectively. Once identified or selected the trigger on the device is pulled one notch activating the spectrum of the device output to a near infrared (850-nanometer wavelength). When activated the information received from the reflection of the target's eyes, which is generally about 10 dB above background in both day and night conditions, will be communicated to the range finder for a calculation of the distance to the target. That distance may be used to manually adjust the beam width for the desired coverage by rotating the perimeter of the head portion of the device. Alternatively the beam width and power input to the lamp may be adjusted automatically by the power control electronics to a level that would provide a visible illumination that is consistent with the measured target range and the user defined beam spread. The device is then properly pointed at the target and the trigger pulled to it's final stop. The target would be instantly illuminated and incapacitated by high-intensity incoherent visible light for approximately twenty minutes and could be apprehended with relative ease.

The invention claimed is:

1. A device for incapacitating one or more target individuals comprising:

an outer housing including a handle portion for gripping by a user and a head portion having a window opening for transmitting a light beam;

a paraboloid reflector mounted in said head portion facing said window opening;

an electric arc lamp for emitting a high intensity incoherent light beam mounted at the focus of the paraboloid reflector;

an adjustable mounting means for adjustably mounting said reflector relative to said electric arc lamp for allowing an electrode gap in the lamp to be located at the focus of said paraboloid reflector;

an electrical circuit means for driving said electric arc lamp; and a means for determining distance to said one or more target individuals.

2. The device according to claim 1 further comprising a means for adjusting the power provided to said electric arc lamp.

3. The device according to claim 2, wherein said electric arc lamp is a Xenon short arc lamp or a Mercury-Xenon short arc lamp.

4. The device according to claim 2, wherein said electric arc lamp is a metal halide lamp or a halogen lamp.

5. The device according to claim 2, wherein said electric arc lamp emits visible light at wavelengths not less than about 380 nm to not more than about 780 nm; that is incoherent; and at a color temperature greater than 5000 degrees Kelvin, and that emits infrared radiation at wavelengths not less than about 780 nm to not more than about 1300 nm.

6. The device according to claim 2 wherein said means for determining distance is an Infrared range finder.

7. The device according to claim 2, further comprising a bezel to accept snap-in lens holder and an additional lens.

8. The device according to claim 2 further comprising a means for releasing said incoherent light from said window opening.

9. The device according to claim 2 wherein said means for releasing is a shutter.

10. The device according to claim 2 wherein said high intensity incoherent light beam is collimated.

11. The device according to claim 2 wherein said paraboloid reflector has an opening in its vertex through which said electric arc lamp projects.

12. The device according to claim 2, wherein said adjustable mounting means comprises adjustment means for moving said paraboloid reflector axially along its central axis.

13. The device according to claim 12, wherein said head portion having a threaded nut and said adjustable mounting means comprising a first set of threads adjustably mounted on an assembly for axial movement of a reflector retainer relative to a baseplate, and a second set of threads on the outside perimeter of said head portion.

14. The device according to claim 13, wherein said baseplate having a central opening, said electrical arc lamp being held within a collet and press-fit engaged by a locking nut through said central opening.

15. The device according to claim 13, wherein said reflector retainer having a central through bore through which said electrical arc lamp projects, said reflector retainer and baseplate having mating threads for allowing adjustment of said paraboloid reflector along said central axis, said reflector retainer having means or grooves to hold an O-ring cradling said paraboloid reflector under compression between a lens and said reflector retainer.

16. The device according to claim 14, wherein said collet having seating surfaces for bringing an anode of said electrical arc lamp into close contact with said baseplate thereby providing an electrical and thermal flow path and surface area for heat removal by a regulated air flow.

17. The device according to claim 2, wherein said electronic circuit means further comprises a power supply for starting and regulating operation of said device.

18. The device according to claim 17, wherein said power supply is at least one of a battery, batteries, a generator, generators, a fuel cell, fuel cells, or an electric utility.

19. The device according to claim 17, further comprising a connector means for connecting said electronic circuit means to said power supply.

20. The device according to claim 17, wherein said electronic circuit means further comprises means for providing a regulated operating power to said device for power supply input voltages in the range of not less than about 10.5 and not more than about 14.5 volts.

21. The device according to claim 20, wherein said means for providing a regulated operating voltage having means for regulating power using a servo, or feedback loop, to said electrical arc lamp after the assembly is switched on.

22. The device according to claim 17, wherein said electronic circuit means further comprises means for placing said circuit on stand-by and cutting off power to said device if said device does not ignite within a predetermined time interval after said circuit is switched on.

23. The device according to claim 17, wherein said electronic circuit means further comprises a delay means for delaying re-lighting of said device for a predetermined time interval after it is turned off.

24. The device according to claim 17, wherein said electronic circuit means includes means for placing said circuitry on stand-by and cutting off power to said device if said circuitry input voltage falls below about 9.5V.

25. The device according to claim 2, further comprising a safety switch for preventing inadvertently having said spotlight turned on upon plugging it in.

26. The device according to claim 2, wherein said outer housing is generally cylindrical, and further comprises an anti-roll means projecting outwardly from said housing for standing said housing on a flat surface.

27. A method for incapacitating one or more target individuals comprising the steps of:

providing a high intensity incoherent light beam emitting device;

identifying and determining the distance to said one or more target individuals;

adjusting the energy to be provided to said device based on said distance;

aiming said device at said one or more target individuals; and activating the device to produce said high intensity incoherent light beam thereby incapacitating said one or more target individuals.

* * * * *

UNITED STATES PATENT AND TRADEMARK OFFICE

CERTIFICATE OF CORRECTION

PATENT NO. : 7,497,586 B2
APPLICATION NO. : 11/824120
DATED : March 3, 2009
INVENTOR(S) : Todd Eisenberg and Herbert Parker It is certified that error appears in the above-identified patent and that said Letters Patent is hereby corrected as shown below:

Col. 17, line 58-59;

Claim 9 which currently reads:

9. The device according to claim 2 wherein said means for releasing is a shutter.

Should be corrected to read:

9. The device according to claim 8 wherein said means for releasing is a shutter.

Signed and Sealed this

Nineteenth Day of May, 2009

JOHN DOLL
*Acting Director of the United States Patent and Trademark Office*